United States Patent [19]

Bertell

[11] 4,454,050

[45] Jun. 12, 1984

[54] AQUEOUS RELEASE AGENT AND LUBRICANT

[75] Inventor: Jerome W. Bertell, South Holland, Ill.

[73] Assignee: Pennwalt Corporation, Philadelphia, Pa.

[21] Appl. No.: 476,950

[22] Filed: Mar. 21, 1983

[51] Int. Cl.[3] ..... C10M 3/18

[52] U.S. Cl. ..... 252/42; 72/42; 252/41; 252/49.3

[58] Field of Search ..... 252/42, 41, 49.3; 72/42

[56] References Cited

U.S. PATENT DOCUMENTS

| | | | |
|---|---|---|---|
| 2,726,215 | 12/1955 | Jones | 252/41 X |
| 2,959,547 | 11/1960 | Brillhart | 252/49.3 X |
| 3,298,953 | 1/1967 | Morway | 252/41 |
| 3,657,123 | 4/1972 | Stram | 252/41 X |
| 4,409,113 | 10/1983 | Bertell | 252/42 |

FOREIGN PATENT DOCUMENTS

| | | | |
|---|---|---|---|
| 2046298 | 11/1980 | United Kingdom | 252/42 |

OTHER PUBLICATIONS

Bastian, E. L. H., "Metalworking Lubricants", McGraw Hill Book Co., 1951, pp.19–20, Aqueous Solutions.

*Primary Examiner*—Andrew Metz

[57] ABSTRACT

A release agent and lubricant composition particularly suitable for die casting operations includes a combination of an alkali metal salt of an aromatic polycarboxylic acid, such as phthalic acid, and an alkali metal salt of an aliphatic polycarboxylic acid such as adipic acid. Other additives may be present including thickeners, preservatives, surfactants, pigments, corrosion inhibitors, and dyes.

20 Claims, No Drawings

AQUEOUS RELEASE AGENT AND LUBRICANT

BACKGROUND OF THE INVENTION

In die casting operations for non-ferrous metals, such as aluminum, zinc, magnesium, copper, tin, lead and their alloys, the dies or molds are coated with a release agent. Aqueous emulsions have been used in the past which leave a wet, oily film on the die. The oily appearance of the film makes it difficult to detect dryness and the degree of die coverage. A dry, adequately coated die surface is required because the presence of water vapor in the die cavity can cause the castings to be porous, and over or under coverage of the die surface causes checking of the dies or sticking of the castings respectively. These emulsion products also produce some smoke. I have now discovered aqueous release agents which provide a dry, easily-detected, visible white film on the die, produce no smoke, and which result in improved quality castings.

BRIEF SUMMARY OF THE INVENTION

In accordance with this invention there is provided a release agent and/or lubricant comprising an aqueous composition containing from about 0.15 to 30 percent by weight of composition of an alkali metal salt of an aromatic polycarboxylic acid and from about 0.015 to 15 percent by weight of composition of an alkali metal salt of an aliphatic polycarboxylic acid such that the weight ratio of aromatic acid salt to aliphatic acid salt ranges from about 50/50 to 95/5.

Also provided is a hot forming process for metal comprising applying a coating of an aqueous lubricant composition, which contains from about 0.15 to 30 percent by weight of composition of an alkali metal salt of an aromatic polycarboxylic acid and from about 0.015 to 15 percent by weight of composition of an alkali metal salt of an aliphatic polycarboxylic acid such that the weight ratio of aromatic acid to aliphatic acid ranges from about 50/50 to 95/5, to the surface of a hot die so as to form a dry film on said surface, placing the metal in the die, forming the metal into a solid state which conforms to the die, and removing the solid, shaped metal from the die.

DETAILED DESCRIPTION

The mold release and lubricant compositions of the invention include a combination of alkali metal salts of an aromatic polycarboxylic acid and an aliphatic polycarboxylic acid. Salts of each type of acid have been used individually as the primary lubricant in compositions useful in hot forging, for example, as is described in British Published application No. 2,046,298 and in U.S. application Ser. No. 317,206, filed Nov. 2, 1981 and now U.S. Pat. No. 4,409,113. Such hot forging lubricants have been found to be of limited usefulness in die casting because they can cause under filling of the mold, sticking of castings to the dies, and staining of the castings. However, I have now discovered that the combination of aliphatic and aromatic acid salts, in certain ratios, avoids or minimizes such problems.

Suitable aromatic acid salts are formed from aromatic polycarboxylic acids such as, for example, phthalic acid, isophthalic acid, terephthalic acid, mellitic acid, benzene pentacarboxylic acid, trimellitic acid, hemimellitic acid, trimesic acid, pyromellitic acid, prehnitic acid, mellophanic acid, naphthalene dicarboxylic acids and mixtures thereof. Suitable aliphatic acid salts are formed from aliphatic polycarboxylic acids containing from about 6 to 12 carbons such as, for example, adipic acid, azelaic acid, sebacic acid, dodecanedioic acid and mixtures thereof. The salts are formed by combining the acids with alkali metal hydroxides, for example, sodium, potassium, and lithium hydroxide, in water in equivalent proportions to neutralize the carboxylic acid groups. It is preferred that the pH of the resulting solution be in the range of about 7.0 to 8.0 in order to optimize the thermal stability, wettability and lubrication properties of the lubricant compositions. Although the pH range is not particularly critical with respect to the lubricating properties of the compositions, the presence of free acid or alkali may cause problems with respect to corrosion, odor and handling and should be avoided (pHs of less than about 5 or greater than about 10).

The aromatic and aliphatic acids in the lubricant compositions are combined in weight ratios of from about 50/50 to 95/5 aromatic to aliphatic acid salt. If the aromatic acid salts are used by themselves as die casting release agents, sticking of the casting to the dies occurs unless the die temperature is carefully controlled. If the aliphatic acid salts are used by themselves, underfilling and black stains on the castings result. Staining can adversely effect surface finish and/or cause excessive porosity as observed after cleaning and painting the castings. By using a combination of aromatic and aliphatic salts within the recited ratio range these problems are greatly reduced and/or eliminated. The surface finish was observed to improve with increasing amounts of aromatic acid salts. Ratios of about 80/20 aromatic to aliphatic acid salt are preferred. Mixtures of aromatic and/or aliphatic acid salts can be used in the compositions.

The compositions can be made up in concentrated form for economy of packaging and shipping and either used neat or diluted with water, for example, up to 50:1 by volume water to concentrate, to form the working solutions. The upper limit of concentration in the concentrates is governed by the solubility of the salts and the lower limit by practical considerations of packaging and shipping costs. The working solution salt concentration will depend upon the particular use, method of application and process parameters. Dilutions of concentrate are usually made by adding up to 50 parts by volume of water. Generally amounts of from about 0.125 to 24.0 percent by weight of composition of aromatic polycarboxylic acid, 0.0125 to 12.5 percent by weight of composition of aliphatic polycarboxylic acid and 0.13 to 24.0 percent by weight of composition of alkali metal hydroxide encompass both the concentrate and the use solutions. These amounts of acid and hydroxide, when mixed, provide aromatic acid salt concentrations in the range of from about 0.15 to 30 percent by weight and aliphatic acid salt concentrations in the range of from about 0.015 to 15 percent by weight. Separate solutions of aromatic polycarboxylic acid salt and aliphatic polycarboxylic acid salt can be mixed to provide the desired ratio of salts for any particular application.

Thickening agents are normally employed with the die release and lubricant compositions and process of the invention to enhance wetting and adhesion on the hot (e.g., 500° F.) dies. The thickening agents are not essential, but permit lower amounts of acid salts to be used.

Suitable organic thickeners include water soluble modified celluloses such as, methyl cellulose, water soluble ether cellulose, sodium carboxymethyl cellulose, methylethyl cellulose, hydroxymethyl cellulose, hydroxyethyl cellulose, potassium carboxyhexyl cellulose, and sodium cellulose glycollate. Caseinates and alginates such as sodium caseinate and sodium alginate can also be used.

Other suitable water soluble thickeners include polymethacrylates, polyvinyl alcohol, modified starches, natural gums such as gum arabic, and polysaccharides.

A preferred organic polymer thickener is hydroxymethyl cellulose which is commercially available from Hercules Chemical under the trademarks NATROSOL 250 H.R. and 250 H.H.R. The thickeners are employed in amounts of from about 0.002 to 5 percent by weight of the composition.

It is desirable to include germicide(s) in the aqueous lubricants to prevent the growth of bacteria and biodegradation, especially of the thickening agents, during storage and shipment of the concentrate lubricants as well as during storage of the dilute aqueous working strength solutions in the feed tanks. Suitable germicides include, for example, DOWICIL 75 (mixture of 67.5% 1-(3-chloroallyl)-3,5,7-triaza-1-azoniaadamantane chloride and 23% sodium bicarbonate) and sodium omadine. Amounts of about 0.002 to 0.2 percent by weight of composition of germicide are effective.

Other additives can be used as is conventional in release agents and lubricants such as surface active agents (including suspending agents, dispersing agents, wetting agents and emulsifying agents), E.P. additives, corrosion inhibitors, anti-wear agents, pigments, dyes, and perfumes.

Surface active agents are advantageously employed in the aqueous system to assist in wetting the surface of the dies. They also are used to disperse, suspend or emulsify the water insoluble components, such as graphite, when they are present, and to level the lubricant composition on the dies. The wetting agents, dispersing agents, and emulsifying agents for aqueous systems are well-known in the art. Many examples of each type are disclosed in McCutcheon's *Detergents and Emulsions,* 1982 edition which is incorporated herein by reference.

Suitable wetting, dispersing and/or emulsifying agents are those which in use produce minimal quantities of smoke and fumes and which have low foaming properties. Anionic agents are preferred. Examples of such agents include sodium salts of naphthalene sulfonic acids, sodium methylnapthalene sulfonate and sodium salts of polyfunctional oligomers such as are marketed by Uniroyal under the mark POLYWET ND-1®. When used, a preferred concentration range of surface active agents in the compositions is from about 0.005 to 5.0 percent by weight of the working strength composition.

Other additives may be used in the lubricating compositions in more severe operations to enhance lubrication and to act as a parting agent. They should generally be avoided, however, to minimize staining and porosity problems. Suitable additives include pigments and water soluble materials such as alkali metal salts of borates, silicates, phosphates and carbonates. Graphite is the most commonly used pigment. Other suitable pigments which may be used to include lithopone, talc, calcium carbonate, zinc oxide, zinc carbonate, mica, magnesium carbonate, and titanium dioxide. When such lubricant enhancers are present, they are used in amounts of from about 0.02 to 25 percent by weight of the working strength composition.

Corrosion inhibitors useful in the invention include: sodium molybdate, sodium benzoate and alkali metal nitrides. Benzotriazole is effective to prevent copper corrosion. When used, a preferred concentration of corrosion inhibitor is from about 0.05 to 5.0 percent by weight of the working strength composition. The amount needed will depend upon the method of application and use concentration with more needed where the equipment is exposed to the solution for longer periods of time, e.g., application by recirculation.

Dyes can serve several useful functions. For example, they are an identifying agent to indicate the supplier of the lubricant. Dyes can also be used to indicate the pH or strength of the aqueous solutions where this is important. Orcoacid alphazurine 2G dye, Blue dye, and Medford Chemical's Green dye are satisfactory. The inclusion of perfume is purely for esthetic purposes. Dyes and perfumes are added in amounts to please the senses.

The lubricant compositions may be formulated as described below. A vessel equipped with stirrer and with either internal or exterior heating and cooling is preferred. Stainless steel is a preferred metal for the mixing vessel. The vessel is charged with cold water and the organic thickener is added with stirring until dissolved. Next, the main portion (about 90%) of the alkali metal hydroxide is added followed by the acids. The temperature is allowed to rise to its natural level and, if necessary, heat is applied to accelerate or complete the reaction. The final portion of alkali metal hydroxide is added until the acid number is between about 0 and 0.3 (a free acid content of about 0 to 0.06 percent by weight). For best results, the solution should not contain any significant amounts of free acid or alkali. Finally, the preservative is added as well as any of the other conventional lubricating additives as may be required. The final solution will be a clear liquid with a semi-gelled or viscous appearance.

The preformed salts of the acids could be added to water although it is more convenient and usually more economical to form the salt in situ by the above salt formation process.

The surface active agents such as dispersants, wetting agents and emulsifying agents are usually added before any pigment and after the thickener.

The lubricant compositions described above can be applied to the dies or other part to be lubricated, such as a plunger, by immersion, by swab, by recirculation of the lubricant over the dies or by spraying. Application by spraying is the most efficient and effective application method.

The compositions and process of the invention are particularly useful in the process of die casting in which molten metal is injected into a die cavity. Non-ferrous metal parts are commonly formed in this manner. The temperature of the molten metal is usually about 200° F. above its melting point, for example, about 1200° to 1300° F. for aluminum. After the die cavity or mold is filled, the metal is cooled and solidified. Die release agents, besides preventing sticking of the parts to the dies, promote good wettability so that complete mold filling is achieved and the surface of the cast part conforms to the surface of the die cavity.

The invention is further illustrated by, but is not intended to be limited to, the following examples wherein parts are parts by weight unless otherwise indicated.

EXAMPLE 1

A release agent and lubricant concentrate was prepared by mixing the following ingredients. The sodium hydroxide reacts with the acids to form their disodium salts in situ.

| Ingredient | % By Weight |
|---|---|
| Water | 73.65 |
| Hydroxyethylcellulose | 1.00 |
| Sodium Hydroxide (50% sol) | 12.75 |
| Isophthalic acid | 6.25 |
| Adipic acid | 6.25 |
| DOWICIL 75 germicide | 0.10 |

The concentrate was diluted by adding 1 part by volume concentrate to 20 parts by volume water. The diluted lubricant was sprayed from a Rimrock airspray wand equipped with a full cone 0.047" nozzle onto the surface of a set of hot dies used for casting aluminum to form a lower gear box for an outboard motor. Spraying the hot (temperature 400°-600° F.) dies resulted in a dry, white film of lubricant which was readily visible so that under or overspraying was easily avoided. The dies were mounted in a horizontal, cold chamber type die casting machine. The shot chamber of the casting machine was filled with molten aluminum and the metal was injected by a plunger into the die cavity. The metal solidified in the dies and the cast part was ejected from the dies without any sticking. The lubricant provided good molten metal flow and underfilling was not a problem. Surface finish was acceptable but not optimized.

EXAMPLE 2

A release agent and lubricant concentrate was prepared by mixing the following ingredients. The sodium hydroxide reacts with the acids to form their disodium salts in situ.

| Ingredient | % By Weight |
|---|---|
| Water | 74.1 |
| Hydroxyethyl Cellulose | 1.0 |
| Sodium Hydroxide (50% sol) | 12.3 |
| Isophthalic acid | 10.0 |
| Adipic Acid | 2.5 |
| DOWICIL 75 germicide | 0.1 |

The concentrate was diluted by combining 1 part by volume of concentrate with 20 parts by volume of water. The process of Example 1 was repeated and an improved surface finish was obtained on the cast parts with no underfill or sticking. The parts passed porosity and paint adhesion tests.

Attempts to cast aluminum parts using a lubricant composition containing only disodium adipate were made. Dilute (40:1) solutions resulted in sticking and more concentrated (20:1) solutions caused staining. A lubricant composition containing disodium isophthalate without the disodium adipate at a 20:1 dilution results in sporadic sticking, if die temperatures were not maintained.

The foregoing examples illustrate the use of the compositions as release agents for die casting. They could also be used as a die casting plunger lubricant or for other metal-forming applications requiring a high temperature lubricant, such as hot forging.

I claim:

1. An aqueous release agent and lubricant comprising water and from about 0.15 to 30 percent by weight of composition of alkali metal salt of an aromatic polycarboxylic acid and from about 0.015 to 15 percent by weight of composition of an alkali metal salt of an aliphatic polycarboxylic acid such that the weight ratio of aromatic polycarboxylic salt acid salt to aliphatic polycarboxylic acid salt ranges from about 50/50 to about 95/5.

2. The release agent and lubricant according to claim 1 wherein the aromatic polycarboxylic acid is selected from the group consisting of phthalic acid, isophthalic acid, terephthalic acid, mellitic acid, benzene pentacarboxylic acid, trimellitic acid, hemimellitic acid, trimesic acid, pyromellitic acid, prehnitic acid, mellophanic acid, naphthalene dicarboxylic acids and mixtures thereof.

3. The release agent and lubricant according to claim 1 wherein the aliphatic polycarboxylic acid is selected from the group consisting of azelaic acid, adipic acid, sebacic acid, dodecanedioic acid and mixtures thereof.

4. The release agent and lubricant according to claim 1 wherein the alkali metal salt of an aromatic polycarboxylic acid is disodium isophthalate and the alkali metal salt of the aliphatic polycarboxylic acid is disodium adipate.

5. The release agent and lubricant according to claim 1 wherein the alkali metal is selected from the group consisting of sodium, potassium, and lithium.

6. The release agent and lubricant according to claim 1 further comprising from about 0.002 to 5.0 percent by weight of composition of a thickening agent.

7. The release agent and lubricant according to claim 6 wherein the thickening agent is an organic polymer.

8. The release agent and lubricant according to claim 7 wherein the thickening agent is hydroxyethyl cellulose.

9. The release agent and lubricant according to claim 1 further comprising from about 0.002 to 0.2 percent by weight of composition of a germicide.

10. A hot forming process for metal comprising applying an aqueous release agent and lubricant comprising water and from about 0.15 to 30 percent by weight of composition of alkali metal salt of an aromatic polycarboxylic acid and from about 0.015 to 15 percent by weight of composition of an alkali metal salt of an aliphatic polycarboxylic acid such that the weight ratio of aromatic polycarboxylic acid salt to aliphatic polycarboxylic acid salt ranges from about 50/50 to about 95/5 to the surface of a hot die so as to form a dry film on said surface, placing the metal in the die, forming the metal into a solid shape which conforms to the die, and removing the solid shaped metal from the die.

11. The process of claim 10 wherein the aromatic polycarboxylic acid is selected from the group consisting of phthalic acid, isophthalic acid, terephthalic acid, mellitic acid, benzene pentacarboxylic acid, trimellitic acid, hemimellitic acid, trimesic acid, pyromellitic acid, prehnitic acid, mellophanic acid, naphthalene dicarboxylic acids and mixtures thereof.

12. The process of claim 10 wherein the aliphatic polycarboxylic acid is selected from the group consisting of azelaic acid, adipic acid, sebacic acid, dodecanedioic acid and mixtures thereof.

13. The process of claim 10 wherein the alkali metal salt of an aromatic polycarboxylic acid is disodium isophthalate and the alkali metal salt of the aliphatic polycarboxylic acid is disodium adipate.

14. The process of claim 10 wherein the alkali metal is selected from the group consisting of sodium, potassium, and lithium.

15. The process of claim 10 wherein said aqueous release agent and lubricant further comprises from about 0.002 to 5.0 percent by weight of composition of a thickening agent.

16. The process of claim 10 wherein the thickening agent is an organic polymer.

17. The process of claim 10 wherein the thickening agent is hydroxyethyl cellulose.

18. The process of claim 10 wherein said aqueous release agent and lubricant further comprises from about 0.002 to 0.2 percent by weight of composition a germicide.

19. The process of according to claim 10 wherein said composition is applied to the die by spraying.

20. The process according to claim 10 wherein said hot forming process for metal is the die casting of aluminum or its alloys in which the molten metal is injected into the die and the metal is cooled and solidified in the die.

* * * * *